US006935937B2

(12) United States Patent
Port

(10) Patent No.: US 6,935,937 B2
(45) Date of Patent: Aug. 30, 2005

(54) TOOL GRINDING JIG

(76) Inventor: Kenneth Leslie Port, P.O.Box 342, Matamata 2271 (NZ)

( * ) Notice: Subject to any disclaimer, the term of this patent is extended or adjusted under 35 U.S.C. 154(b) by 0 days.

(21) Appl. No.: 10/729,707

(22) Filed: Dec. 5, 2003

(65) Prior Publication Data

US 2005/0120573 A1 Jun. 9, 2005

(51) Int. Cl.[7] ..... B23Q 3/18
(52) U.S. Cl. ..... 451/369; 451/380; 33/626; 33/630
(58) Field of Search ..... 33/630, 626, 628, 33/636, 637, 643, 555.1, 562, 568, 569, 573; 451/380, 367, 369

(56) References Cited

U.S. PATENT DOCUMENTS 277,882 A * 5/1883 Carr ..... 451/369
2,369,642 A * 2/1945 Benning ..... 451/375
2,411,609 A * 11/1946 Zenick ..... 451/375
2,911,771 A * 11/1959 Amiet ..... 451/375
2,998,683 A * 9/1961 Wegener ..... 451/364
3,482,325 A * 12/1969 Mitchell ..... 451/369
6,393,712 B1 * 5/2002 Jansson ..... 33/628

OTHER PUBLICATIONS

Turning Topics: Sharpening Gouges, by Jerry Glaser, from Woodworker West, Mar./Apr. 1997, pp. 39-42.

* cited by examiner

*Primary Examiner*—Christopher Fulton
(74) *Attorney, Agent, or Firm*—Innovation Law Group, Ltd; Jacques. M. Dulin, Esq.

(57) ABSTRACT

A hand tool grinding jig is described for use in co-operation with a grinding wheel. The jig has a tool clamp for clamping a hand tool and a leg is pivotally connected to the clamp to allow the angle between the leg and the clamp to be adjusted. An end of the leg remote from the clamp provides a pivot point for engagement in a pivot receiver of a pivot support member that is located adjacent to the grinding wheel. The pivot receiver is disposed so that, when a tool is in the tool clamp and the pivot point is provided in the pivot receiver, the pivotal axis between the leg and the clamp is further from the grinding wheel than the pivot receiver.

14 Claims, 6 Drawing Sheets

TOOL GRINDING JIG

FIELD OF THE INVENTION

The present invention relates to a tool grinding jig for grinding hand tools such as gouges, scrapers, chisels, lathe bits, drill bits, carving tools, carpenters chisels. The invention has particular, but not exclusive, application to woodworking tools.

BACKGROUND, INCLUDING DESCRIPTION OF THE PRIOR ART

Hand tools frequently need to be ground in order to provide the desired tool shape, in particular to sharpen the tools, the edges of which become dull after continued use. Unless the person grinding the tool is very experienced, grinding tools correctly is a difficult and time consuming exercise.

A number of grinding jigs have been proposed to facilitate the task of grinding hand tools, particularly woodturning tools such as gouges. In one known form of apparatus, a pivot block is provided on the floor in front of a grinder which is mounted on a bench. The tool is held by a clamp which has a leg that ends in a pivot point that is received in the pivot block. The leg is angularly adjustable relative to the clamp about a clamp pivot axis, which clamp pivot axis is located in use between the grinder and the pivot block. Such apparatus is made and sold by Glaser Engineering Co. of El Segundo, Calif., USA.

Another system is that disclosed in U.S. Pat. No. 6,393,712 (Jansson) which provides a horizontal support that is parallel to the axle of the grinding wheel and has a clamp for the tool which is pivotally mounted relative to the support.

These known forms of jig have the disadvantage that they can only be used to effectively shape or sharpen a limited variety of tools, or provide only a limited variety of ground shapes to tools. They can also be difficult to use and time consuming to set up.

Accordingly, there is a need in the art for a grinding tool jig that can accommodate a wide variety of hand tool types for sharpening or shaping, that is easy to set up and use, that is capable of being used in the field independent of the flooring or ground surface type, and that is more compact and versatile.

THE INVENTION

SUMMARY, INCLUDING OBJECTS AND ADVANTAGES

The invention comprises a hand tool grinding jig for use in co-operation with grinding apparatus having a rotatable grinding wheel, the jig comprising in combination:

- a tool clamp for clamping a tool,
- a leg pivotally connected to the clamp about a leg pivotal axis and angularly adjustable relative to the clamp, the leg having a pivot point at an end thereof remote from the clamp,
- a pivot support for location adjacent to the grinding apparatus and having a pivot receiver adapted to receive the pivot point in one or more locations, and
- the pivot support being adjustable so that the position of the pivot receiver may be adjusted relative to the grinding wheel to allow the tool to be provided at a required angle relative to the grinding wheel.

In another aspect the invention provides a method of shaping a hand tool comprising the steps of:

- clamping the tool in a clamp having a leg pivotally connected about a leg pivotal axis to the clamp and angularly adjustable relative to the clamp, the leg having a pivot point at an end thereof remote from the clamp,
- providing a pivot receiver closely associated with a grinding wheel,
- adjusting the position of the pivot receiver relative to the grinding wheel to allow the tool to be provided at a required angle relative to the grinding wheel, and
- rotating the tool about the pivot point to shape the tool.

The invention may also broadly be said to consist in any new part feature or element disclosed herein, or any new combination of such parts, features or elements. Accordingly it is an object of the present invention is to provide a jig that will enable a wide variety of tools to be sharpened or shaped. Another object of the invention is to provide a jig which allows a scraper tool to be shaped or sharpened. Further objects may become apparent from the following description which is given by way of example only.

BRIEF DESCRIPTION OF THE DRAWINGS

The invention will now be described in more detail with reference to an exemplifying embodiment and with reference to the accompanying drawings, in which.

DETAILED DESCRIPTION, INCLUDING THE BEST MODE EMBODIMENTS

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

Figure 1:
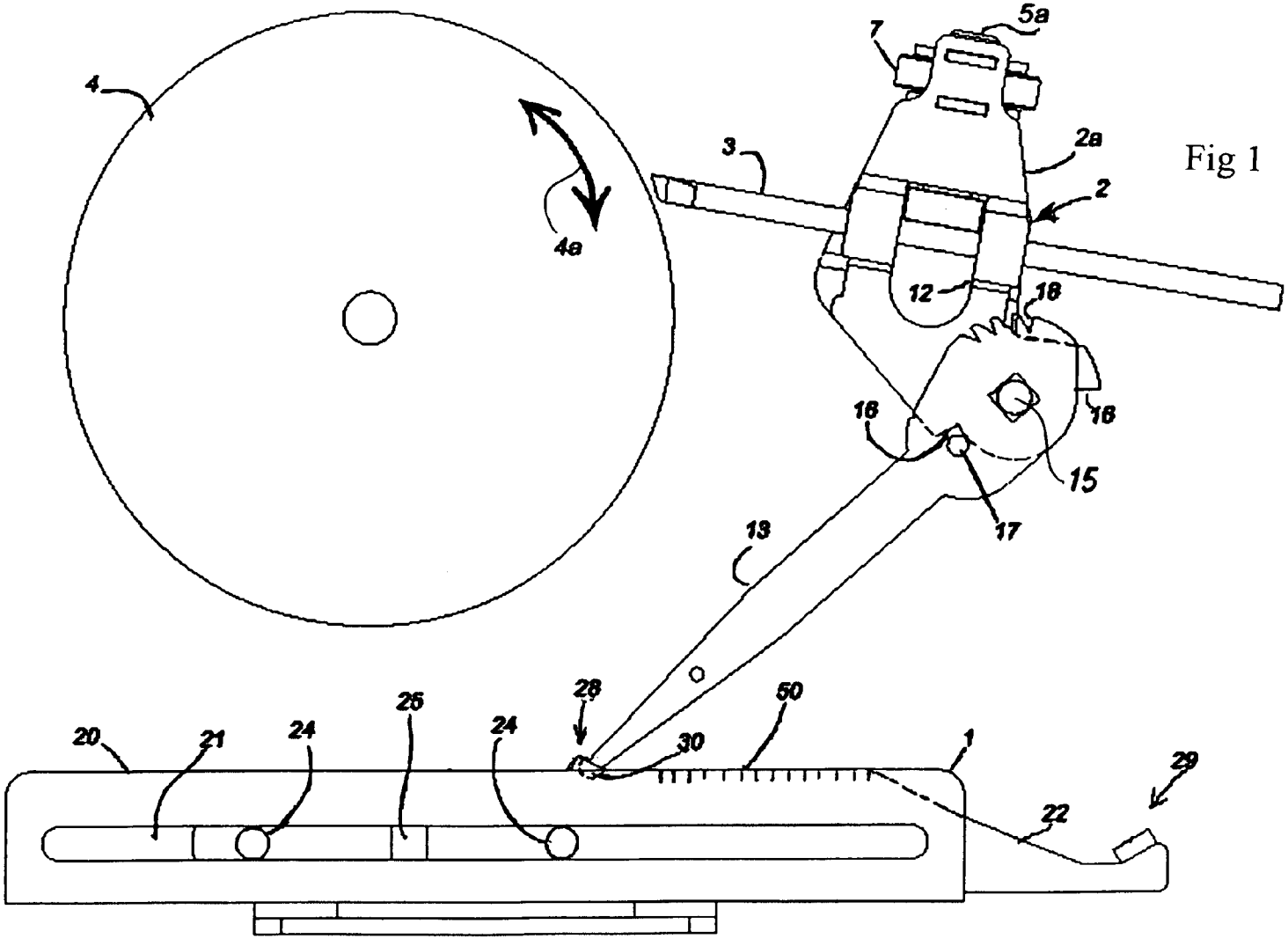
FIG. 1 Is a side elevation of a jig according to the invention using a first pivot receiver, FIG. 2 Is a partial side elevation of a tool clamp of the jig of FIG. 1, FIG. 3 Is a partial front elevation of the tool clamp as shown in FIG. 2, FIG. 4 Is a side elevation of the jig of FIG. 1 showing use of a second pivot receiver, FIG. 5 Is an isometric view of the apparatus as shown in FIG. 1, FIG. 5A Is a partial isometric view of a tool nose shaped using the jig as shown in FIG. 1, FIG. 6 Is an isometric view of the apparatus as shown in FIG. 4, and FIG. 6A Is a partial isometric view of a tool nose shaped using the jig as shown in FIG. 4.

Referring to the drawing Figures, a jig apparatus according to the invention is shown in side elevation in FIG. 1 comprising two main components being a pivot receiver support 1 and a tool clamping portion 2 for clamping a hand tool such as a woodworking tool. A tool 3 is shown diagrammatically held within the clamping portion and located adjacent to grinding apparatus having a grinding wheel 4 for rotation in either direction, as indicated by bi-directional arrow 4*a*. The grinding wheel 4 is illustrated diagrammatically for ease of illustration.

Figure 2:
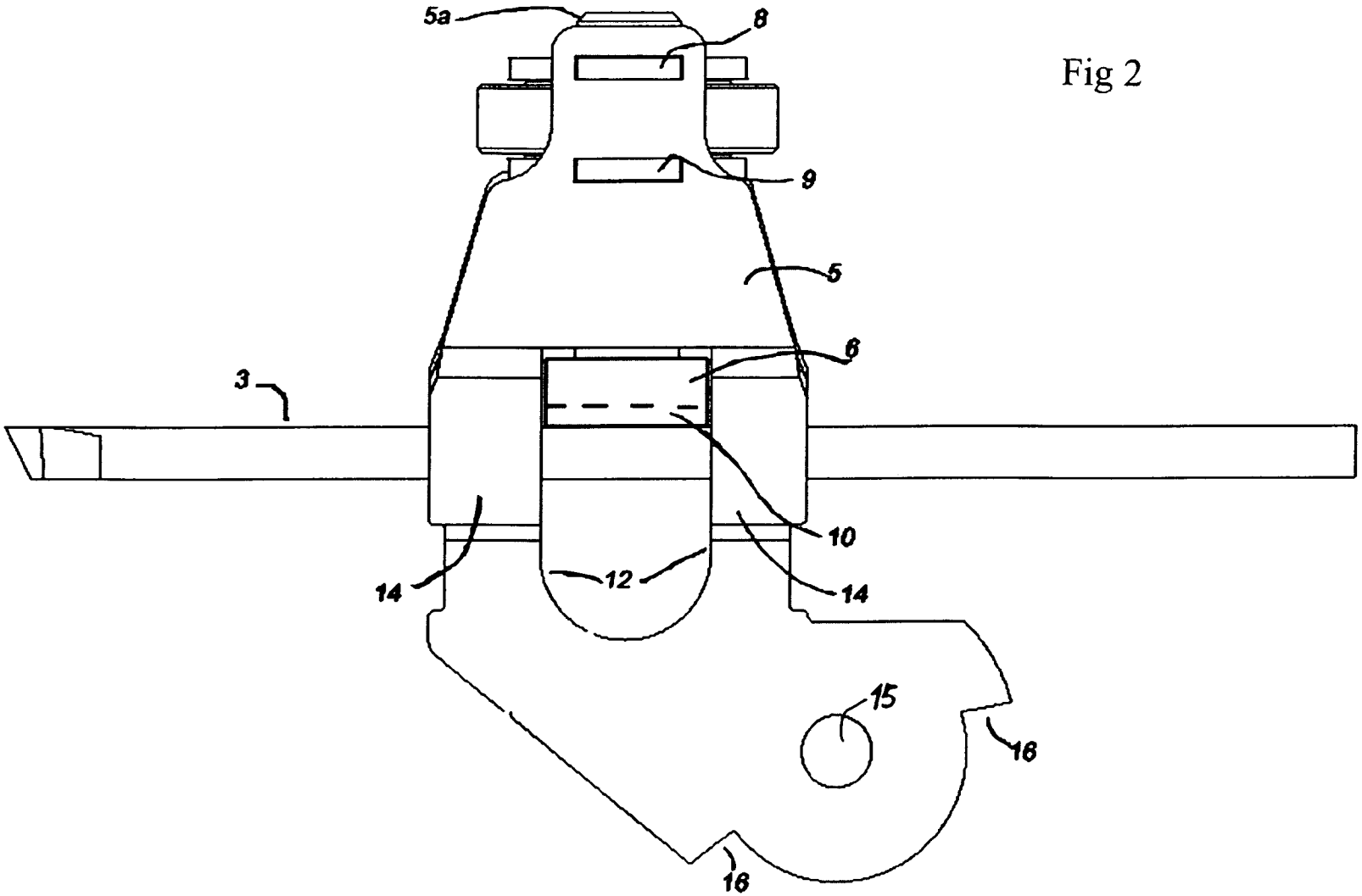
Figure 3:
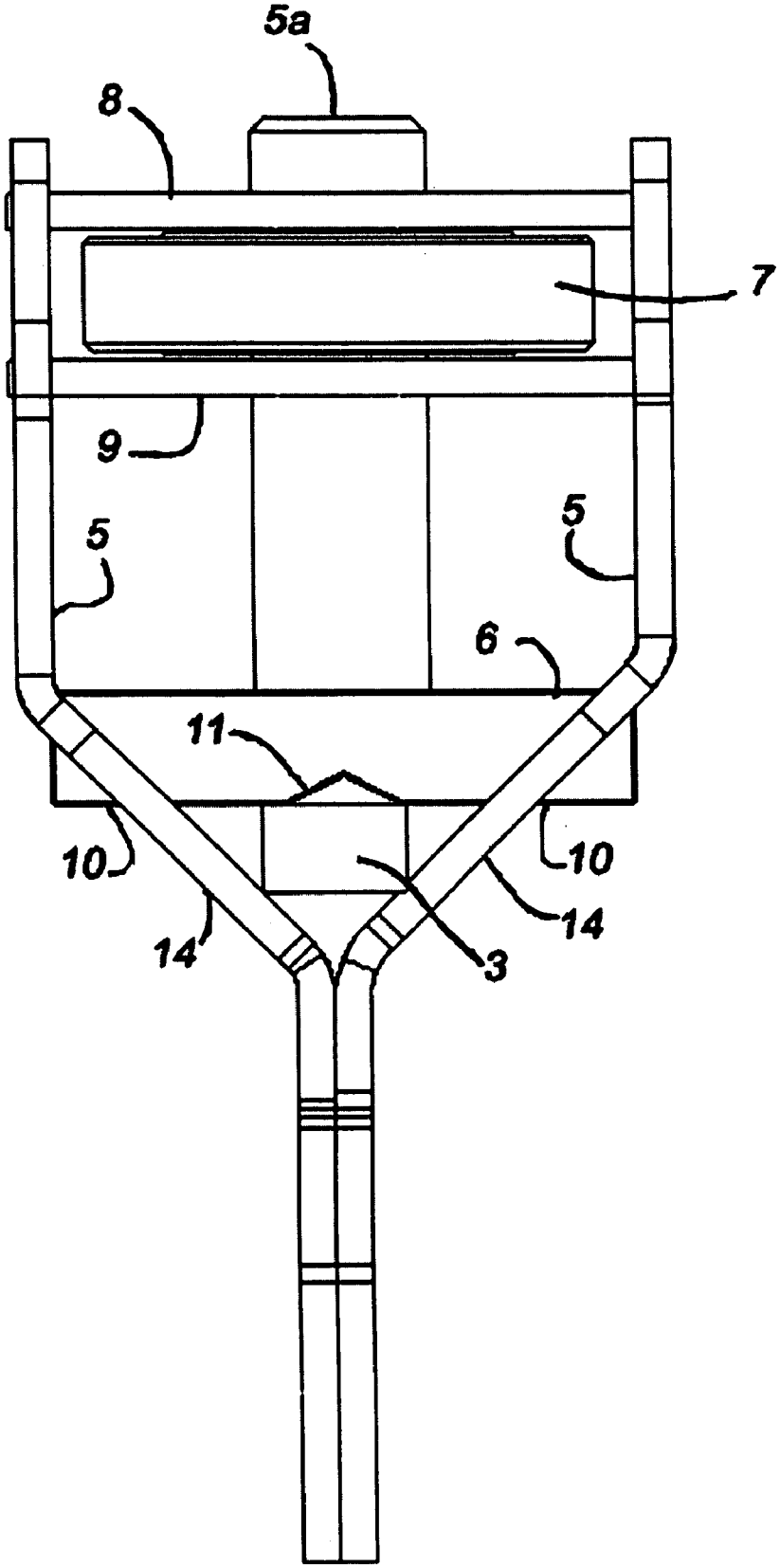

The clamping portion 2 includes a tool clamp 2*a* which is best seen with reference to FIGS. 2 and 3. The clamp includes side walls 5 relative to which a clamping block 6 may be moved by rotation of an adjustment knob 7 (shown in FIG. 1, but not in FIGS. 2 and 3 for clarity). The block 6 is rotatably connected to threaded shaft 5*a* so that the shaft 5*a* may rotate relative to the block 6 which is prevented from rotating by walls 5. Shaft 5*a* is rotated by knob 7 which has an internal thread so that rotation of knob 7 results in the threaded shaft 5 moving axially to thereby move block 6 up or down (in the jig orientation shown in the drawings). Axial movement of knob 7 is prevented as it is captured between walls 8 and 9 (but allowed to rotate relative to those walls).

Block 6 has a substantially planar lower engagement surface 10 that is interrupted by a notched or curved recess 11. The lower wall portions 14 of walls 5 angle inwardly. Therefore, notch 11 in combination with the lower walls 14 provide clamping surfaces which may suitably be used to clamp substantially circular objects such as woodturning gouges, or may also be used to secure objects which have a flat surface, such a chisels. This is because objects that have a round or curved cross-section may be clamped between walls 14 and the walls or edges of notch 11. Objects such as tools that have a square or rectangular cross section may be clamped between walls 14 and the planar surface 10. The angled wall surfaces 14 (and 11 where appropriate) ensure that the tool is centred in the clamp.

Walls 14 include apertures 12 (which are best shown in FIG. 2). These allow the edges of block 6 to pass therethrough as illustrated in FIG. 3. This has the advantage that the block 6 can be lowered considerably i.e. to a point where the apex of notch 11 is at or below the lowermost extremity of the intersection of the walls 14. Therefore, tools which have a very small diameter or cross sectional dimension may be securely clamped using this apparatus.

The pivot receiver support 1 comprises two main components, a substantially stationary component 20 and a slide component 22 which is moveable relative to component 20. Stationary component 20 is in use affixed to an object so as to remain stationary relative to the grinding apparatus. Therefore, in use component 20 may be affixed directly to the grinding apparatus, for example, by being secured using fasteners such a screws or bolts (not shown) to a frame of the grinding apparatus. Alternatively, component 20 may be secured indirectly so as to remain stationary relative to the grinding apparatus, for example by being affixed using fasteners such as screws or bolts to a bench or other structure or object to which the grinding apparatus is also affixed.

Stationary component 20 includes an elongate slot 21. Moveable slice component 22 includes guide pins 24, which may comprise nut and bolt arrangements, pins or rivets for example, that slide in slot 21 while holding the components 20 and 22 adjacent to each other but allow the components to be moved slideably relative to each other along the path of the slot 21. The parts can be reversed, with the slot being in the slidable component 22 and the pins affixed to the fixed component 20. A locking element 25, which may comprise an adjustable nut and bolt, can be adjusted by a user so as to apply a force between members 20 and 22 to pinch the members together to thereby frictionally engage and lock the members relative to each other. In this way the relative position of members 20 and 22 can be adjusted and then locked in place.

Moveable member 22 includes two pivot receivers 28 and 29 both of which are adapted to receive a pivot point 30 of leg 13 which is pivotally mounted about a pivot 15 which is preferably provided by a pin or nut and bolt (not shown) that may be selectively tightened to provide a frictional adjustment relative to the clamp assembly. Pivot receivers 28 and 29 each comprise a flange or tab 34 and 35, having a dimple or socket 36 and 37 respectively, to receive the ball or point 30 of leg 13. The pivot receivers are provided in the plane of the grinding wheel 4, and may be located on an arc passing through the centre of the grinding wheel. The pivot receivers are shown fixed relative to each other but adjustable for and aft along lines parallel to a tangent to the grinding wheel 4. Although the tangs or flanges 34, 35 are shown fixed relative to each other, they may be adjustable to each other. For example only one pivot receiver may be provided on sliding component 22 and a further elongate slotted component can be introduced which may be adjusted relative to component 22 and carry the other pivot receiver.

As another alternative, only one pivot receiver may be provided on slide member component 22, and this component may be adjustable relative to the remainder of the support so that the single pivot receiver can be adjusted to provide a range of pivot receiver positions that is the same as or similar to the range provided by the arrangement of separate pivot receivers described above.

The pivot receiver support 1 is mounted in close association with the grinding wheel 4, preferably below the wheel and in such a way that the pivot receivers are in the plane of the wheel 4. The support 1 may alternatively be provided above the base of wheel 4.

Shoulders 16 of the clamp assembly in combination with a projection such as pin 17 may provide a limit to the range of angular movement of leg 13 relative to the remainder of the clamp portion 2. Notches 18 in the leg are provided so that users may determine a reference point or measurement of the angle of the leg 13 relative to the clamp (and thus relative to the tool). For example, the notches may be counted and noted on a tool so that the angle can be repeated subsequently when the tool needs to be re-sharpened.

The pivot receivers 28 and 29 and the pivot point 30 may take a variety of different forms. For example, the pivot point 30 may comprise a sharp point at the end of the leg and the pivot receivers 28 and 29 may comprise dimples or sockets such as conical depressions which may be used to centre and support the point 30. In the embodiment shown in the drawings, pivot point 30 is provided in part circular or part spherical form at the end of the leg 13 and the pivot receivers 28 and 29 are part spherical depressions. The arrangement of the pivot receivers and pivot point is such that the pivot point 30 may be rested in either of the pivot receivers 28 or 29 such that the clamping portion 2 may be rotated about the pivot point to provide a desired angle of incidence of the tool 3 against grinding wheel 4 to provide a required grind to the tool i.e. to provide its desired shape to the tool or to simply sharpen the tool.

Figure 4:
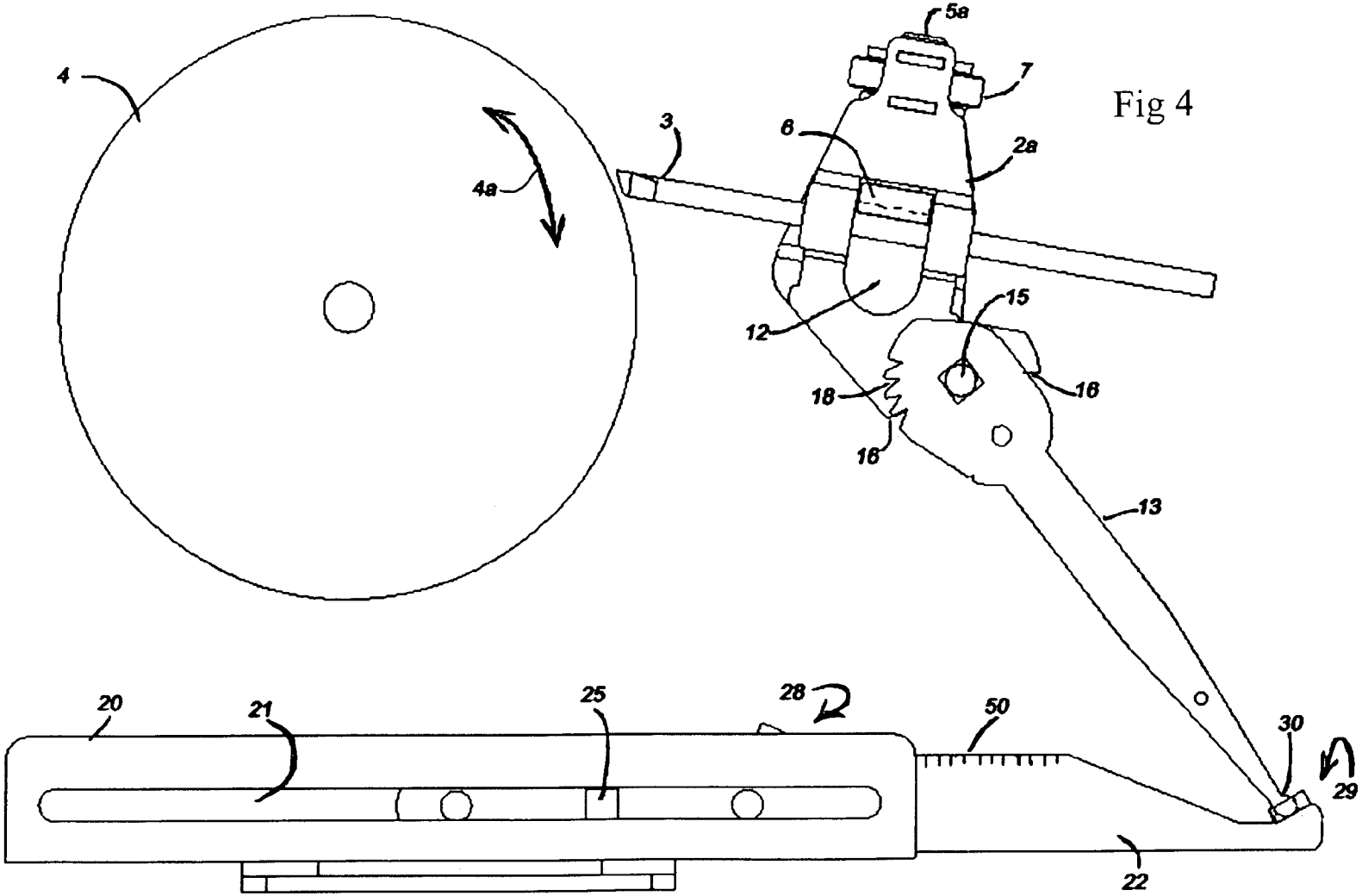

As shown in FIG. 4, the provision of the pivot point 30 in the second pivot receiver 29 may provide a different grind to be applied to the tool as compared with provision of the pivot point 30 in the first region 28. In particular, as can be seen in FIG. 1, the pivot receiver 28 may be provided almost immediately below the edge of the grinding wheel 4.

In use a user affixes pivot support 1 to the grinder frame or to an object that is fixed relative to the grinder so that the pivot receivers 28 and 29 are located in a plane that passes through the grinding wheel 4 and is perpendicular to the rotational axis of the wheel. The user then selects the tool that requires re-shaping, for example sharpening, and places the tool in between the walls 14 and the clamp block 6. A selected length of the tool, preferably about two inches, is adjusted to project from the front of the clamp toward the grinding wheel 4. The user rotates knob 7 to tighten the tool in the clamp so that it is held securely.

Depending on the tool, the user then determines which pivot point is to be used. For example, if the tool is a scraper or lathe bit type, then the first pivot receiver 30 may be used. The position of the pivot receiver may be adjusted by moving slide member 22. Graduations 50 may assist selection of the most appropriate position for the tool. As shown in FIG. 1, location of the first pivot receiver results in an arrangement being adopted in use whereby the first pivot receiver is forward of the leg pivot 15 i.e. the leg pivot is further from the grinding wheel than the pivot receiver.

Figures 5, 5A:
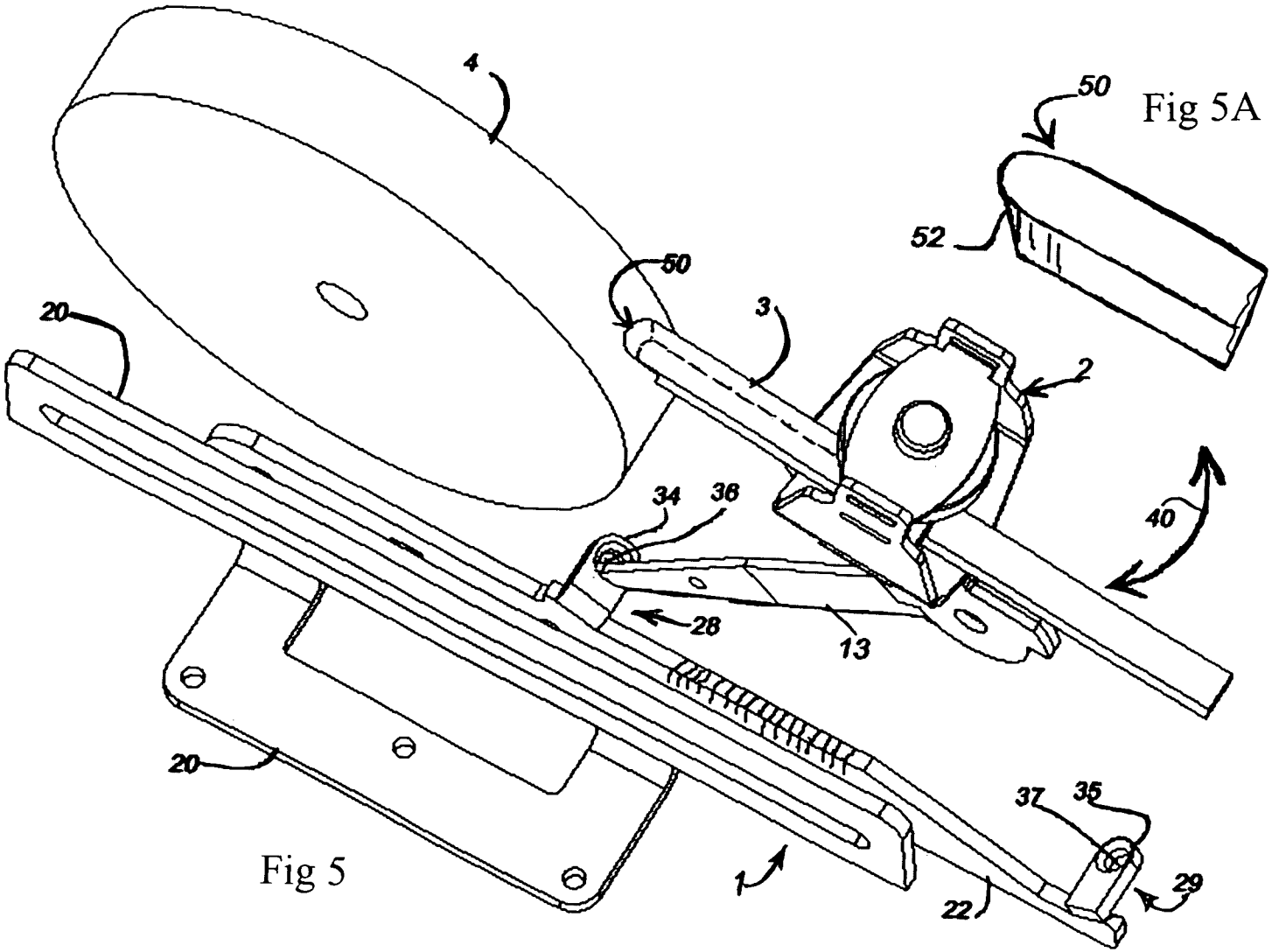

The angle of the leg 13 relative to the clamp is then selected and the set firmly. The pivot point 30 is then located in the relevant pivot receiving region and the tool face is brought into contact with the grinding wheel with a user guiding the clamp portion 2 by holding the clamp and/or the rear part of the tool while resting the apparatus on the pivot receiver. FIG. 5 shows use of the first pivot receiver. As shown in FIG. 5, this allows the nose 50 of the tool to be placed in contact with the grinding wheel at a substantially constant angle so that a regular, substantially semi-circular, bevelled contour or facet can be formed on the tool. The user maintains the nose of the tool against or adjacent to the wheel 4 and moves the clamp portion 2 back and forth in a transverse arc of rotation as shown by arrows 40 having a centre point at the pivot 30 of leg 13. A bevel applied to a tool using the arrangement and movement described with reference to FIG. 5 is shown in FIG. 5A where the substantially semi-circular bevel shown by shaded area 52 can be seen. This form of bevel is suitable for sharpening a number of hand tools such as woodworking tools known to those skilled in the art as scrapers and lathe bits.

Figures 6, 6A:
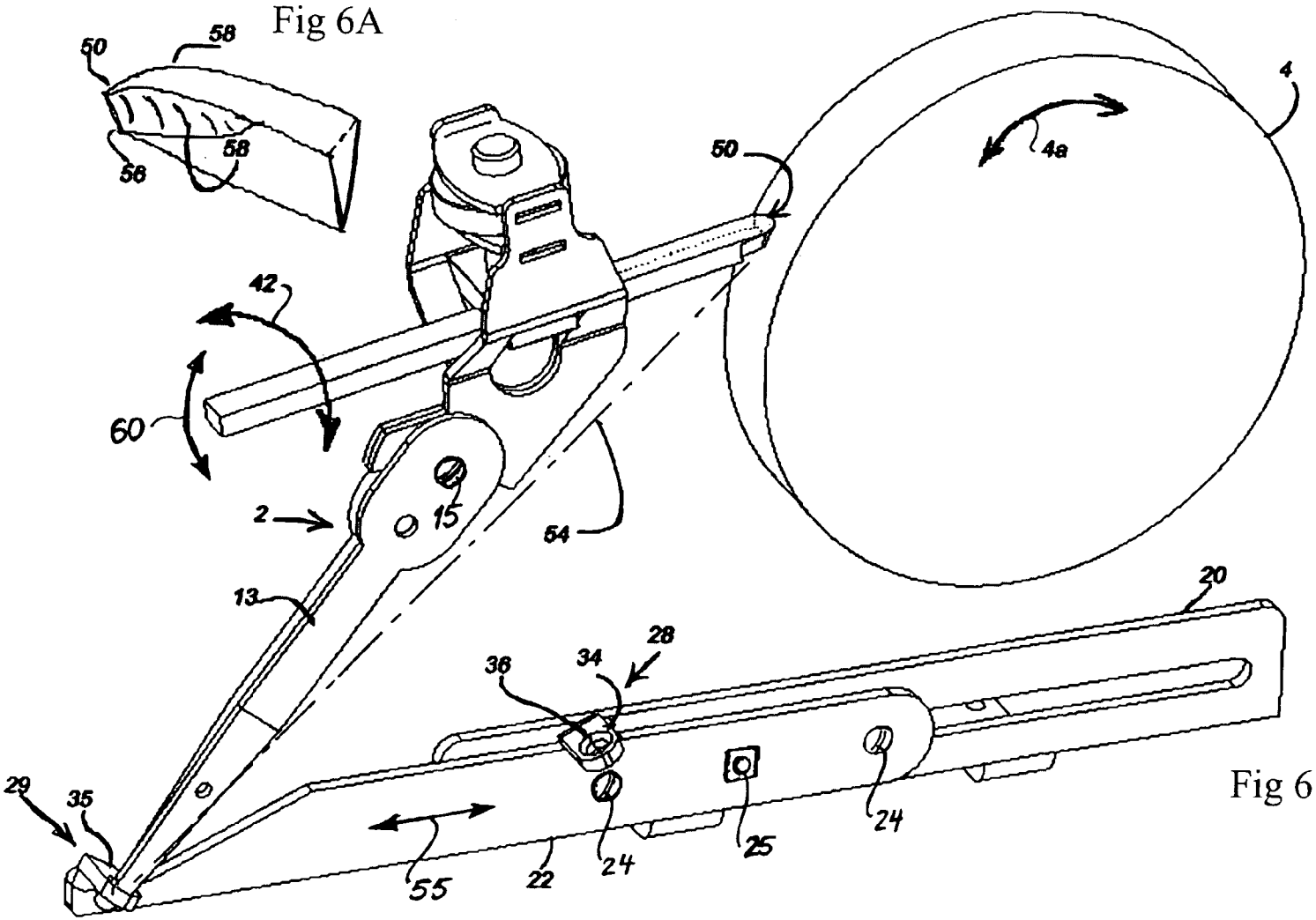

Alternatively, as shown in FIGS. 4 and 6, the clamp portion 2 may be supported by the second pivot receiver 29 and guided by a user so that the tool nose 50 is maintained against or adjacent to the wheel 4 while the clamp portion 2 is rocked back and forth in an arc centred about an axis shown by broken line 54 that extends between the tool nose 50 and the pivot 30. The motion is indicated by arrow 42 in FIG. 6. This provides a different bevel to that described above with reference to FIG. 5. Movement of the tool as shown in FIG. 6 will result in the tool nose 50 being placed in contact the grinding wheel such that the angle between the grinding wheel and the tool decreases as the tool is rotated from the distal end of the tool nose to either side of the tool. An example of the bevel that may be produced is shown in FIG. 6A, where the bevel is shown by shaded area 56 on the tool. The bevel is a complex shape having an angle that changes from the distal end of the tool nose to the sides 58 of the nose. This is particularly useful for shaping or sharpening hand tools such as woodworking tools known to those skilled in the art as gouges or chisels such as bowl gouges, skew chisels, fingernail gouges, spindle gouges, parting tools "V" chisels and flat chisels.

FIG. 6A shows by way of example a V gouge or chisel, but the cross-section could be solid as shown by the dashed line. FIG. 6 also shows arrow 55 which indicates that the locking bolt 25 can be loosened and the slide moved fore and aft to give a tapered grind to the tool nose. In addition, by loosening pivot 15, the tool nose can be rocked up and down as shown by the corresponding arrow 60 at the back of the tool.

Leg 13 is relatively short, being in the order of 0.5 to 2.5 times the diameter of the grinding wheel 4. I have found that the short length of leg 13 and the motion used allows a tighter radius bevel to be applied to the tool nose. Thus, a more pronounced transverse "cup" can be applied to the tool which is not possible, or at least very difficult to achieve with known jigs. Furthermore, the adjustable positions of the pivot receivers relative to the grinding wheel allows a much greater variety of complex planes in three dimensions to be applied to the tool to produce the desired bevel than known constructions are capable of achieving.

The jig as a whole also has a compact form factor, making it easy to transport and set up and allowing it to be used on a portable bench or in conjunction with a portable grinder if required. When assembled the jig also takes up little working space.

Wherein the foregoing description reference has been made to specific components or integers of the invention having known equivalents then such equivalents are herein incorporated as if individually set forth.

Although the invention has been described by way of example and with reference to possible embodiments thereof, it is to be understood that modifications or improvements may be made thereto without departing from the scope of the invention.

What is claimed is:

1. A hand tool grinding jig for use in co-operation with grinding apparatus having a rotatable grinding wheel, the jig including in combination:

a tool clamp for clamping a tool, a leg pivotally connected to the clamp about a leg pivotal axis, said leg is angularly adjustable relative to the clamp and said leg has a ball or point-type pivot point element at an end thereof remote from the clamp, at least one pivot support for location of said pivot point element adjacent to the grinding apparatus and having a pivot receiver adapted to receive said pivot point element, and said pivot support is adjustable so that the position of the pivot receiver may be adjusted relative to the face of the grinding wheel to allow the tool to be provided at a required angle relative to the grinding wheel face, said adjustment ranging from at least a first, forward position for said pivot receiver lying below said grinding wheel and between about the outer face of said grinding wheel and the center axis of rotation of said grinding wheel to a second, back position that is outboard of the leg-to-clamp pivot distance from the face of the grinding wheel.

2. A jig as claimed in claim 1 wherein the pivot receiver is disposed so that when a tool is disposed in the tool clamp and the pivot point is disposed in the pivot receiver the leg pivotal axis is further from the grinding wheel than the pivot receiver.

3. A jig as claimed in claim 1 wherein the pivot receiver is disposed so that when a tool is disposed in the tool clamp and the pivot point is disposed in the pivot receiver the leg pivotal axis is closer to the grinding wheel than the pivot receiver.

4. A jig as claimed in claim 1 wherein two pivot receivers are provided, each pivot receiver being provided in a plane of the grinding wheel.

5. A jig as claimed in claim 1 wherein the clamp includes a clamping block which is moveable relative to two intersecting walls to clamp the tool between internal surfaces of the walls and the clamping block.

6. A jig as claimed in claim 1 wherein the clamp includes a clamping block which is moveable relative to two intersecting walls to clamp the tool between internal surfaces of the walls and the clamping block, and the walls each having an aperture therein to receive a side of the clamping block.

7. A jig as claimed in claim 6 wherein the clamping block may be moved substantially adjacent to the point of intersection between the walls.

8. A jig as claimed in claim 6 wherein said clamping block extends through said apertures in said intersecting walls.

9. A jig as claimed in claim 1 wherein the pivot support comprises a first part adapted to be affixed adjacent to the grinding apparatus and a second part which carries the pivot receivers, the second part being adjustably movable relative to the first part.

10. A method of shaping a hand tool comprising the steps of:

clamping the tool in a clamp having a leg pivotally connected about a leg pivotal axis to the clamp and angularly adjustable relative to the clamp, the leg having a ball- or point-type pivot point element at an end thereof remote from the clamp, providing at least one pivot point element receiver closely associated with a grinding wheel positioned in at least a first, forward portion lying below said grinding wheel and between about the outer face of said grinding wheel and the center axis of rotation of said grinding wheel adjusting the position of the pivot receiver and the angle of said leg relative to the grinding wheel to allow the tool to be provided at a required angle relative to the face of the grinding wheel, and moving the tool about the pivot point element to shape the tool, said ball- or point-type pivot point permitting said tool to move around a portion of a plurality of axes.

11. A method as claimed in claim 10 including the step of adjusting the pivot receiver so that when a tool is disposed in the tool clamp and the pivot point is disposed in the pivot receiver the leg pivotal axis is further from the grinding wheel than the pivot receiver.

12. A method as claimed in claim 10 including the step of adjusting the pivot receiver so that when a tool is disposed in the tool clamp and the pivot point is disposed in the pivot receiver the leg pivotal axis is closer to the grinding wheel than the pivot receiver.

13. A method as claimed in claim 11 including the step of moving the tool about the pivot point such that a nose of the tool may be placed in contact with the grinding wheel at a substantially constant angle.

14. A method as claimed in claim 12 including the step of moving the tool about the pivot point such that a nose of the tool may be placed in contact the grinding wheel and the angle between the grinding wheel and the tool nose decreases as the tool is rotated from the tool nose to a side of the tool.

* * * * *